United States Patent [19]

Smith

[11] Patent Number: 4,763,852

[45] Date of Patent: Aug. 16, 1988

[54] OSCILLATING GUIDE ROLL

[76] Inventor: Donald L. Smith, Rt. 12, Sleepy Hollow Dr., Greenville, S.C. 29609

[21] Appl. No.: 65,696

[22] Filed: Jun. 16, 1987

Related U.S. Application Data

[63] Continuation of Ser. No. 769,478, Aug. 26, 1985, abandoned.

[51] Int. Cl.[4] ..... B65H 17/08; D03D 49/20

[52] U.S. Cl. ..... 242/67.1 R; 139/304; 242/76; 226/179

[58] Field of Search ..... 242/158.5, 158.2, 76, 242/55, 62, 67.1 R, 67.3 R, 66; 226/196, 179; 139/304, 306

[56] References Cited

U.S. PATENT DOCUMENTS

| | | | |
|---|---|---|---|
| 2,624,119 | 1/1953 | Magnuson | 242/158.2 X |
| 2,979,829 | 4/1961 | Uhleen | 226/179 X |
| 3,235,934 | 2/1966 | Miller | 226/179 X |
| 3,344,969 | 10/1967 | Collinge et al. | 226/179 X |
| 3,799,464 | 3/1974 | Bosch | 242/158.5 X |
| 4,252,154 | 2/1981 | Alexander, III | 242/66 X |
| 4,390,139 | 6/1983 | Alexander, III | 242/67.1 R X |
| 4,492,257 | 1/1985 | Alexander, III | 242/66 X |

*Primary Examiner*—Stuart S. Levy
*Assistant Examiner*—Katherine Matecki
*Attorney, Agent, or Firm*—Dority & Manning

[57] ABSTRACT

An oscillating guide roll for use in winding cloth onto a take-up roll distributes the cloth so that the edge or selvage portions which are thickened do not remain in register. A stationary non-rotating shaft has a hollow guide roll mounted thereon. The guide roll both rotates about the shaft, and oscillates relative the longitudinal axis of the shaft. Apparatus entirely enclosed within the hollow guide roll is mounted therein for rotation relative the stationary non-rotating shaft, and actuated solely by rotation of the guide roll about such shaft. Rotation of the guide roll is transmitted to such apparatus at a rotational speed different from that of the guide roll. Thus, registry of the thickened edge portions is avoided without requiring actuation of the apparatus other than by rotation of the guide roll.

8 Claims, 2 Drawing Sheets

OSCILLATING GUIDE ROLL

This is a continuation of application Ser. No. 06/769,478, filed Aug. 26, 1985, which was abandoned upon the filing hereof.

FIELD OF THE INVENTION

This invention relates to an oscillating guide roll for use in winding cloth onto a take-up roll to distribute the cloth so that the edge or selvage portions which are thickened do not remain in register thus avoiding buildup of excessively large end portions on the roll.

BACKGROUND OF THE INVENTION

Materials such as paper or cloth which are manufactured in sheet-like webs are often provided with thickened edges which prevent the material from being torn or unraveled. However, in winding up such a material, if the thickened edges are allowed to register one on top of the other, the edges of the roll will have an appreciably larger diameter than the center of the roll which can result in wrinkling of the material or even buckling of the roll. In the prior art, in order to avoid registry of the edge portions, devices have been provided to oscillate the supply roll, to oscillate the takeup roll, and to oscillate an intermediate guide roll. The latter solution often proves to be best as oscillation of the supply or takeup rolls which can be quite heavy is not often easily or satisfactorily achieved.

One patent which discloses an apparatus wherein the cloth is fed directly from a loom to the takeup roll utilizing an intermediate oscillating guide roll is U.S. Pat. No. 4,252,154 which issued on Feb. 24, 1981 to William J. Alexander, III. In this device, the mounting shaft for the guide roll is slidably journaled in a bearing for transverse motion and driven in transverse or lateral oscillating motion by a worm gear powered crank.

It is one object of the present invention to eliminate any need for powered driving means to provide oscillating motion for a guide roll.

Another prior art oscillating guide roll is disclosed in U.S. Pat. No. 4,390,139 which issued on June 28, 1983, also to William J. Alexander, III. This guide roll is also power driven, but employs cam mechanisms within the roll adjacent each end thereof to provide the oscillating motion. In such prior art devices, driving chains or gears must be provided on the side of the loom or windup mechanism which are quite cumbersome, expensive, and difficult to install and maintain.

Accordingly, it is another object of the present invention to provide an oscillating guide roll which can be simply installed, requires a minimum of space, and can be used either directly on a loom or in a separate rewind device.

Still another object of the present invention is to provide an oscillating guide roll in which the oscillating means are enclosed and protected from clogging by dirt, lint, or debris.

SUMMARY OF THE INVENTION

It has been surprisingly found that the foregoing and other objects are achieved by the present invention which, in one aspect, is an oscillating guide roll assembly for use in winding cloth or the like onto a takeup roll which comprises: a stationary shaft, a hollow guide roll rotatably mounted for oscillating movement along the length of the shaft; and, enclosed means for oscillating the guide roll back and forth along a length of the shaft as the guide roll is rotated by the cloth passing thereover.

The enclosed means for oscillating the guide roll may advantageously comprise a cam follower mounted internally on the guide roll shell; a slotted cylindrical cam concentrically and rotatably mounted on the shaft with the cam follower positioned in the slot, the cam being restrained from movement along the length of the shaft; and, means for rotating the cylindrical cam at a rate greater than the rate at which the guide roll is rotated.

In another aspect, the guide roll is provided with means on at least a portion of the surface thereof for preventing slippage between the roll and the cloth passing thereover.

The guide roll construction designed to carry out the invention will be hereinafter described, together with other features thereof.

DESCRIPTION OF THE DRAWINGS

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
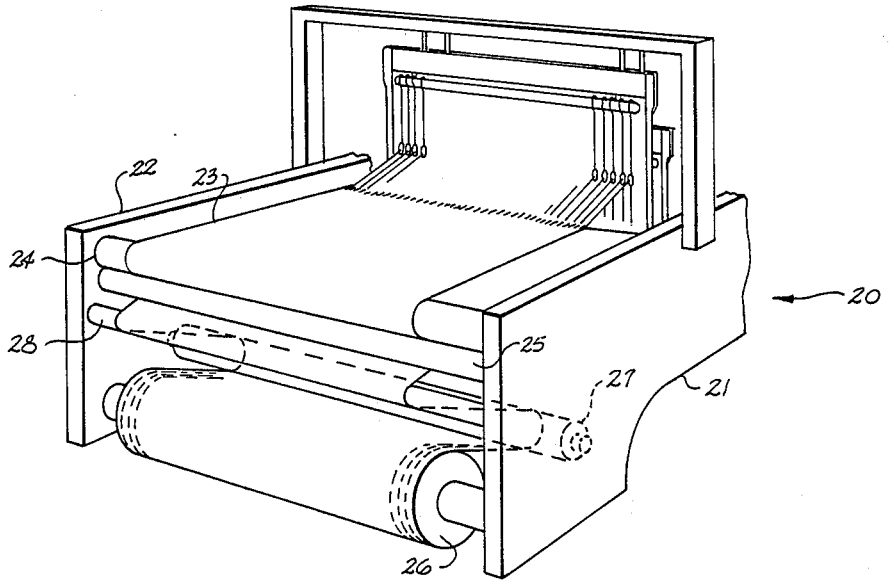
FIG. 1 is a schematic representation of a loom having an oscillating guide roll of the preferred embodiment of present invention installed thereon.

Looking first at FIG. 1, loom 20 is shown having side frames 21 and 22. Freshly woven cloth 23 is shown moving over a stationary guide roll 24, being fed around idler roll 25, then back over another idler roll 28 from where it loops around oscillating guide roll 27 which guides the cloth 23 onto takeup roll 26. The dotted lines on takeup roll 26 represent the distribution of the selvage or edges of the cloth on the takeup roll 26 in response to the oscillating movement of the guide roll 27.

Figure 2:
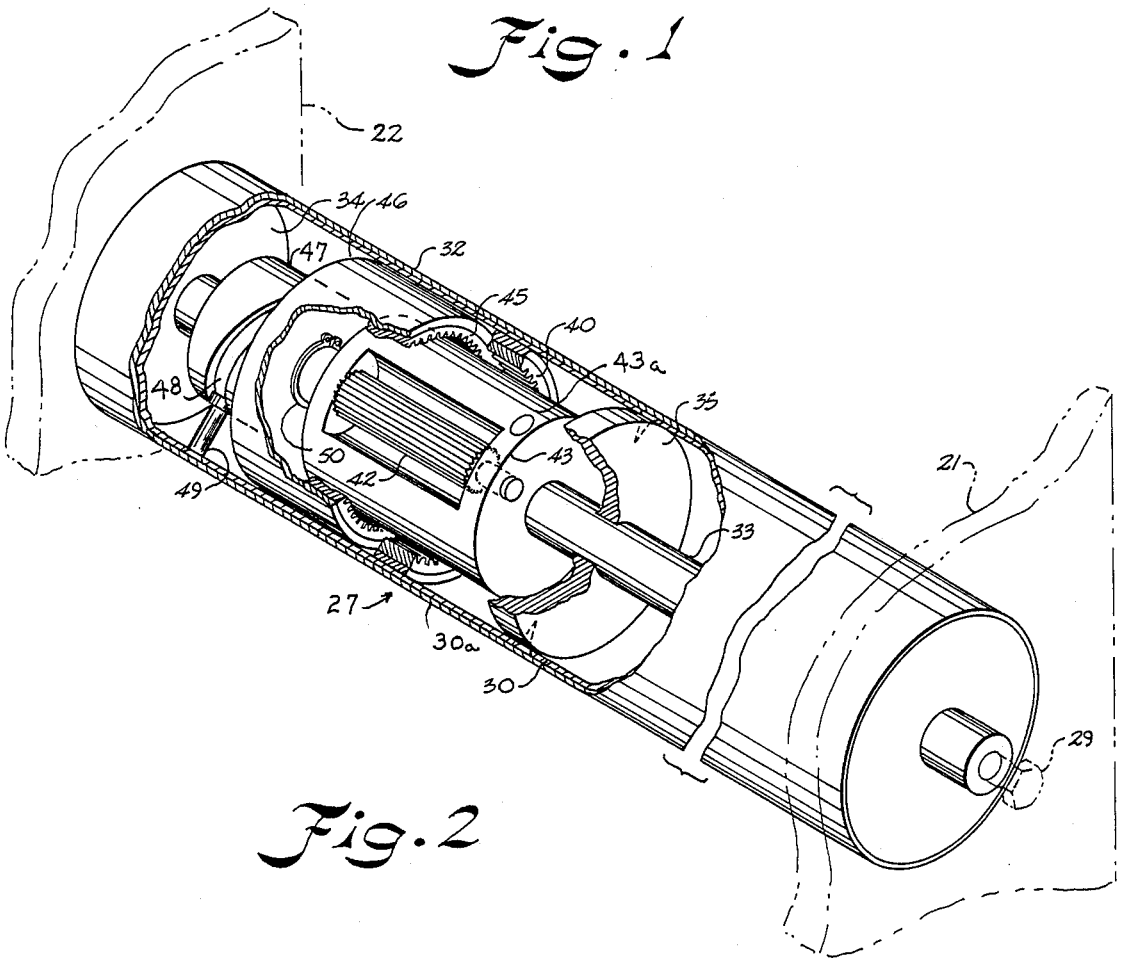
FIG. 2 is a perspective view, partially cut away, of a preferred embodiment of the present invention.

Turning now to FIG. 2, hollow guide roll 27 is shown in perspective with part of the shell 30 being cut away. The stationary shaft 33 is bolted into the side walls 21 and 22 by bolts 29 and from this view it can be appreciated how quickly and simply the guide roll 27 can be installed as compared to guide rolls which employ complicated sprockets, chains, or gears to rotate or turn the shaft. In the present invention, the shaft is simply bolted by one bolt at each end thereof into the frame and remains stationary.

Figure 3:
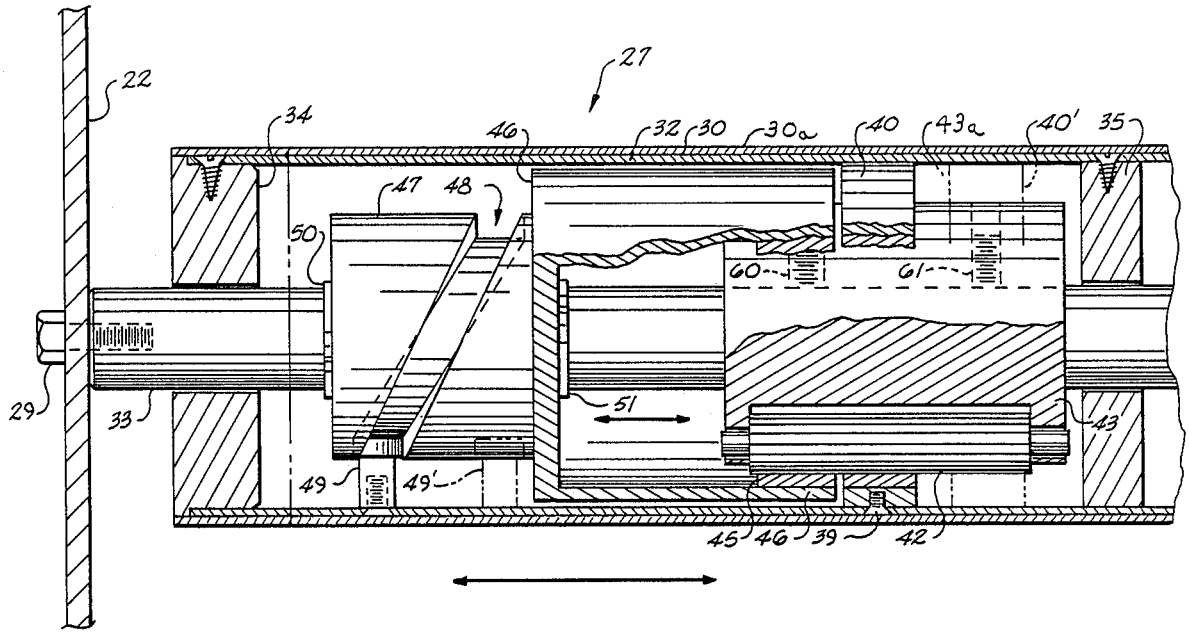
FIG. 3 is a side view in partial section of a preferred embodiment of the invention.

Still referring to FIG. 2, cylindrical cam 47 with inclined cam slot 48 in its surface is shown concentrically mounted on the shaft 33 for rotation but restrained from movement along the shaft by retaining rings 50 and 51 whose positions can be better appreciated by viewing FIG. 3. However, still viewing FIG. 2, cam gear housing 46 is shown secured to the cylindrical cam 47. The cam gear housing has a ring-like gear 45 disposed therein and the outer surface of the ring gear 45 is in contact with and secured to the housing 46. The inner surface of ring gear 45 is provided with teeth which are in mesh with the teeth of elongated slide gear 42 which is carried by yoke 33 formed in the slide gear housing 43*a*. Slide gear 42 also meshes with the teeth on the inner surface of ring gear 40 whose outer surface is in contact with and secured to the inner surface of the shell 30 of the roll 27. Bearings 34 and 35 further stabilize the housing on the shaft 33 and also act as closures to prevent dirt or debris from entering and/or contaminating the enclosed means for oscillating the guide roll.

In FIG. 3, cam follower 49 which projects from the inner surface of shell 30 of the guide roll is shown positioned in cam slot 48 of cylindrical cam 47. The angle of the cam slot determines the extent of the lateral displacement of cam follower 49 as it goes through a complete oscillation. In shadow lines, the position 49′ of the cam follower is shown at the extreme displacement of the follower to the right as the cylindrical cam is rotated. Also shown in shadow line is the position 40′ of the ring-like roll gear at its extreme right-hand position. In addition in FIG. 3, set screws 60 and 61 which secure the slide gear housing 43*a* to shaft 33 can be seen. The position of slide gear 42 and its mounting in the yoke 43 is also shown in FIG. 3. The outer surface of shell 30 is provided with a rubber sleeve or coating or other rubber-like material or friction-type surface 30*a* that will prevent slippage between the cloth passing over the roll and the roll as the cloth passes over and around the oscillating guide roll 27 as shown in FIG. 1, thereby providing the rotational force to horizontally oscillate guide roll 27.

In operation, as the guide roll is rotated by cloth 23, ring gear 40 will rotate slide gear 42. Ring gear 40 is preferably provided with forty-seven teeth around its inner periphery. As the slide gear 42 is thus rotated, it in turn rotates cam drive gear 45. The slide gear does not rotate about shaft 33 nor does it move horizontally.

Cam drive gear 45 is provided with forty-six teeth so that it will be rotated at a slightly greater rate than the roll 27. (Ratios other than 47 to 46 can be used but this ratio provides a satisfactory rate of oscillation for many textile applications.) The cam drive gear 45 turns the cam gear housing 46 which is secured to the cylindrical cam 47. Since the cylindrical cam 47 is now rotating at a greater rate than the cam follower 49 which is fixed to the shell 30, the difference in angular velocities creates a force that causes follower 49 to move within slot 48 which, in turn, causes lateral displacement of the oscillating guide roll 27. As the slot is continuous around the cylindrical cam, the cam follower will move to the shadow line position 49′ and return to its full line position for a complete cycle. During this cycle, the roll gear 40 is sliding with its teeth still meshed in slide gear 42. Likewise, the bearings 34 and 35 allow the housing to slide along the shaft 33 which is slidably journaled in these bearings. Thus, the entire oscillating means is enclosed within the shell 30 of the oscillating roll 27 and the oscillating movement is provided solely by the cloth turning the guide roll.

Figure 4:
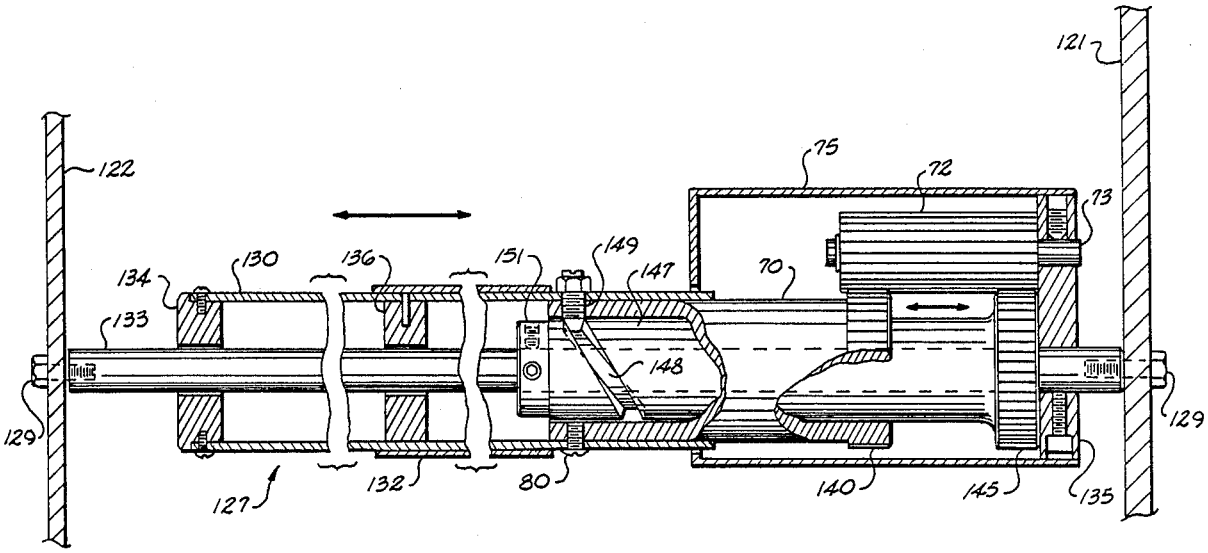
FIG. 4 is a side view in partial section of an alternate embodiment of the present invention.

Turning now to FIG. 4, an alternate embodiment of the present invention is shown. Stationary shaft 133 is shown secured to side walls 121 and 122 of a loom or rewind device by bolts 129. Cylindrical cam 147 is rotatably and concentrically mounted on shaft 133 and is restrained from movement along the shaft by restraining ring 151. Cam slot 148 is placed in an inclined fashion in the surface of cylindrical cam 147 adjacent one end thereof. At the other end of the cylindrical cam is cam drive gear 145 which meshes with elongated slide gear 72 that is carried by and rotates around axle 73 which is mounted in end closure 135. End closure 135 also restrains cam 147 from moving along shaft 133. The slide gear 72 meshes at its other end with roll drive gear 140 which is formed in one end of cylindrical housing 70 which concentrically encloses the cylindrical cam 147 and is secured by screw 80 to shell 130 of the guide roll 127. The roll gear housing 70 can rotate independently of the cylindrical cam 147. Cam follower 149 is secured to the roll shell 130 and is disposed within the cam slot 148. Bearings 134 and 136 serve to support and stabilize roll 127 and to close one end thereof.

In operation, the alternate embodiment of FIG. 4 will have cloth passing around the rubber-like surface 132 which is attached as a sleeve to the shell 130 and this will rotate the shell which, in turn, will rotate the roll drive gear 140 which is preferably provided with forty-nine teeth. Roll gear 140, in turn, rotates slide gear 72 and slide gear 72 drives cam gear 145 which is provided with forty-eight teeth. As cam gear 145 rotates, consequently, at a faster rate than the shell 130 is turning, again relative motion is set up between the cam follower 149 and the cylindrical cam 147. This causes the follower 149 to move along the inclined slot 148 and move the roll 127 in oscillating movement.

In the alternate embodiment, the slide gear 72, the roll gear 140, and the cam gear 145 are all enclosed within housing 75. Bearings 134 close one end of shell 130 and provide stabilizing support along the length of shaft 133.

While a preferred embodiment and an alternate embodiment of the invention have been described using specific terms, such description is for illustrative purposes only, and it is to be understood that the words used are words of description rather than of limitation and that various changes may be made without departing from the spirit and scope of the invention herein disclosed.

I claim:

1. An oscillating guide roll assembly for use in winding cloth with thickened edge portions onto a takeup roll, comprising:

(a) a stationary non-rotating shaft;

(b) a hollow guide roll mounted on said stationary non-rotating shaft for rotation thereabout and for oscillating movement along the longitudinal axis of said shaft;

(c) oscillatory movement means, enclosed entirely within said hollow guide roll, mounted therein for rotation relative said stationary non-rotating shaft, and actuated solely by rotation of said guide roll about said stationary non-rotating shaft, for oscillating said guide roll along the longitudinal axis of said shaft as said guide roll is rotated by cloth passing thereover; and (d) means for transmitting the rotation of the guide roll to the oscillating movement means at a rotational speed different from that of the guide roll, whereby such cloth is wound onto the takeup roll to avoid registry of the thickened edge portions on such takeup roll without requiring actuation of said oscillatory movement means other than by rotation of said guide roll.

2. The guide roll assembly of claim 1 wherein said oscillatory movement means includes means on at least a portion of the surface of the guide roll for preventing slippage between the roll and the cloth.

3. The guide roll assembly of claim 1 wherein said oscillatory movement means is adjacent one end of the guide roll with the shaft passing therethrough and includes means on at least a portion of the surface of the guide roll for preventing slippage between the roll and the cloth.

4. The guide roll assembly of claim 1 wherein:

said oscillatory movement means comprises a cam follower projecting from the inner surface of the guide roll; and a slotted cylindrical cam concentrically and rotatably mounted on the shaft with the cam follower positioned in the slot, said cam being restrained from movement along the length of the shaft; and said means for transmitting includes means for rotating the cylindrical cam at a rate greater than the rate at which the guide roll is rotated.

5. An oscillating guide roll assembly for use in winding cloth or the like onto a takeup roll, comprising:

(a) a stationary shaft;

(b) a hollow guide roll, at least a portion of the outer surface of the guide roll being provided with means to prevent slippage between the cloth and the roll;

(c) means for mounting the guide roll for concentric rotation about the shaft and for oscillating movement along the length of the shaft;

(d) a cam follower secured to the roll and projecting from the interior surface of the roll;

(e) a slotted cylindrical cam mounted for rotation about the shaft, said cam being at least partially enclosed by the roll and being restrained from movement along the length of the shaft, the cam follower being positioned in the slot of the cylindrical cam;

(f) an elongated slide gear;

(g) means for mounting said elongated slide gear with its longitudinal axis parallel to the shaft, said mounting means being stationary;

(h) roll gear means for driving said elongated slide gear, said roll gear means being mounted to rotate in response to rotation of said roll and to slide along the elongated slide gear in response to oscillating movements of said roll; and (i) cam gear means for rotating the cylindrical cam, the cam gear means being driven by the slide gear and having fewer teeth than the roll gear means whereby the cam rotates at a greater rate than the roll, thereby moving the follower in the cam slot and causing the roll to oscillate along the length of said shaft as said roll is rotated by the movement of the cloth thereover.

6. The oscillating guide roll assembly of claim 5 wherein the cylindrical cam, slide gear, slide gear mounting means, roll gear means, and cam gear means are enclosed by the guide roll.

7. The oscillating guide roll assembly of claim 5 wherein the slide gear and slide gear mounting means are located adjacent one end of said roll and including a housing enclosing the elongated gear and mounting means.

8. An oscillating guide roll assembly for use in winding cloth or the like onto a guide roll comprising:

(a) a stationary shaft adapted for mounting in a frame;

(b) a cylindrical cam having a continuous slot, said cam being mounted for rotation on the shaft, and said cam being restrained from movement along the shaft;

(c) a ring-like cam gear having gear teeth on its inner surface;

(d) a cam gear housing concentrically positioned on the shaft and secured to the cam, the cam gear being mounted within the cam gear housing with its outer surface in contact with the inner surface of said housing;

(e) an elongated slide gear;

(f) a mounting yoke for the slide gear, said yoke being concentrically mounted on the shaft and secured thereto, said mounting yoke carrying the slide gear so that its teeth mesh with those of the cam gear;

(g) a hollow, cylindrical guide roll enclosing said cylindrical cam, said ring-like cam gear, said cam gear housing, said elongated slide gear, and said mounting yoke, said roll being concentrically mounted on said shaft with bearings at each end thereof;

(h) a ring-like roll gear having at least one more gear tooth on its inner surface than said cam gear, said roll gear being secured to the inner surface of the roll with its teeth in mesh with the teeth of the slide gear; and, (i) a cam follower projecting from the inner surface of the roll, the follower being positioned within the cam slot whereby when cloth passes over the roll and rotates the roll, the cam gear is rotated at a rate greater than the roll thus causing the cam follower to move along the cam slot and oscillate the roll.

* * * * *